United States Patent [19]

Bassetti

[11] Patent Number: 4,583,478

[45] Date of Patent: Apr. 22, 1986

[54] DEVICE FOR GATHERING AND RETAINING A PORTION OF A FABRIC

[75] Inventor: Piero Bassetti, Milan, Italy

[73] Assignee: Bassetti, S.p.A., Milan, Italy

[21] Appl. No.: 585,449

[22] Filed: Mar. 2, 1984

[30] Foreign Application Priority Data

Mar. 14, 1983 [IT] Italy ..... 21104/83[U]

[51] Int. Cl.[4] ..... A41D 1/00; B32B 7/08

[52] U.S. Cl. ..... 112/413; 2/76; 2/114; 2/221; 2/237

[58] Field of Search ..... 112/413; 2/76, 237, 2/221, 108, 105, 114, 243 R

[56] References Cited

U.S. PATENT DOCUMENTS

| | | | |
|---|---|---|---|
| 1,120,814 | 12/1914 | Herbard | 2/237 X |
| 1,951,380 | 3/1934 | Wagenfeld | 2/52 |
| 2,185,425 | 1/1940 | Benowitz | 2/237 |
| 3,039,466 | 6/1962 | Wilson | 128/287 |
| 3,397,406 | 8/1968 | Leach | 2/96 |
| 3,413,657 | 12/1968 | Sherriff | 2/221 |
| 4,164,792 | 8/1979 | Ito | 2/237 X |
| 4,457,024 | 7/1984 | Wichman | 2/114 X |

FOREIGN PATENT DOCUMENTS

| | | |
|---|---|---|
| 490886 | 5/1919 | France . |
| 478537 | 11/1969 | Switzerland . |
| 493819 | 11/1938 | United Kingdom . |
| 1110699 | 5/1970 | United Kingdom . |

*Primary Examiner*—Werner H. Schroeder
*Assistant Examiner*—J. L. Olds
*Attorney, Agent, or Firm*—John C. Andres

[57] ABSTRACT

A device for gathering and retaining a portion of a fabric article such as an article of clothing, includes a first, elastic ribbon- or cord-shaped element fastened at one end to the article to be gathered within a seating or sleeve provided on the fabric article. The first element is also attached at at least two points to a second ribbon- or cord-shaped element such that the overlapping portion of one of the elements is longer than that of the other element. A rigid lamina is provided attached to the larger overlapping portion to engage the front edge of the fabric sleeve, thereby securing the fabric in the gathered position.

16 Claims, 5 Drawing Figures

DEVICE FOR GATHERING AND RETAINING A PORTION OF A FABRIC

TECHNICAL FIELD

The predent invention relates to a device to gather and stably retain a portion of a fabric article in the gathered position.

BACKGROUND AND OBJECTS OF THE INVENTION

The present invention relates to a device for the stable retention of elastic or non-elastic ribbon-shaped or cord-shaped elements slidably mounted within a seating formed on a portion of a woven or non-woven fabric article in order to cause gathering and fastening of a portion of the fabric article. The present invention can be applied to linen or fabric clothing articles where gathering and fastening is desired. Heretofore known fastening elements such as buttons and buttonholes, buckles, hooks and eyes, hooks, self-adhesive fasteners, knotting and snap-fasteners, etc. are not suitable in certain cases to obtain gathering of fabric due to bulk, thickness, deterioration or especially due to the inconvenient, non-instantaneous nature of fastening and release obtained therewith.

The main object of the present invention is to provide a retention device which is simple to construct, easy to use and has great functional reliability, and which also allows the user to easily restore the gathered fabric article to its initial ungathered condition.

SUMMARY OF THE INVENTION

To attain this object the present invention embodies a device for gathering a portion of a woven or non-woven fabric article, such as an item of linen or clothing, and for retaining such portion in the gathered position. The device consists of two ribbon-shaped or cord-shaped elements slidable within a seating formed between fabric layers on the article. The ribbon-shaped or cord-shaped elements consist of a first elongated element fastened at one end to the article to be gathered within the seating and connected to a second elongated element protruding freely from the seating. The connection between the first and second elements is effected at two spaced apart points on the two elements such that the portion of one of the elements between the two points is longer than the corresponding portion of the other element. The longer portion has a first rigid lamina at least partially fastened to it.

The first rigid lamina assumes an unlocked position against the shorter element portion between the element connection points and be may held in this position by a second rigid lamina fastened between the first and second ribbon- or cord-shaped elements.

In use, as the second element is pulled out of the seating a portion of the fabric article is gathered and the first lamina separates fron the second lamina. The second element may thereafter be relaxed with the device in the gathered position such that the first lamina engages the front edge of the fabric defining the opening of the seating to hold the first ribbon- or cord-shaped element in the pulled or extended position, thereby holding the fabric article in the gathered position. The gathered fabric may be released by again pulling on the second element to disengage the first rigid lamina from the seating edge and subsequently relaxing the second and, consequently, first elongated elements while urging the first lamina away from engagement with the front edge of the seating opening and into the seating. The first rigid lamina may also be re-engaged with the second lamina.

It will be understood that the foregoing general description and the following detailed description as well are exemplary and explanatory of the invention but are not restrictive thereof.

BRIEF DESCRIPTION OF THE DRAWINGS

The functional and structural characteristics and advantages of a device according to the present invention will be more clearly understood from the following detailed description of preferred embodiments of the present invention, and from the attached drawings, referred to herein and constituting a part hereof, in which.

DETAILED DESCRIPTION OF THE PREFERRED EMBODIMENTS

Figures 1, 2:
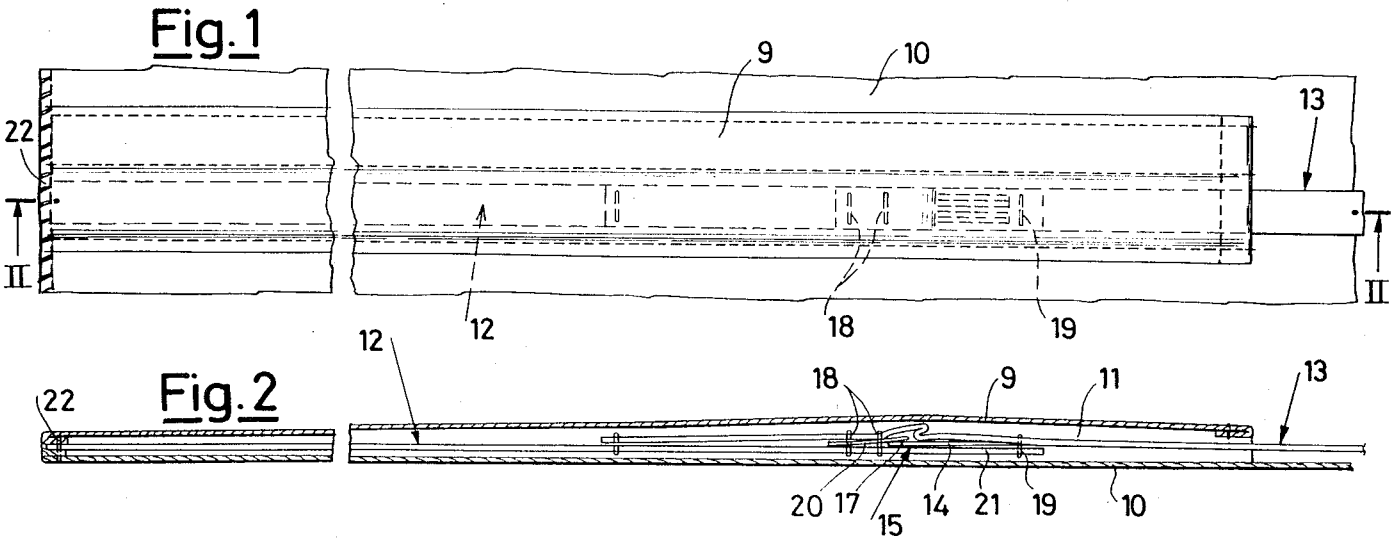
FIG. 1 is a plan view of a first preferred embodiment according to the present invention with parts of the device disposed within the seating and, therefore, hidden from view shown in phantom.
FIG. 2 is a sectional view in the direction of the line II—II of FIG. 1.

With reference to the drawings, a woven or non-woven fabric article 10, such as item of linen or clothing, is provided with a strip-like portion of covering fabric 9 forming a seating 11 adapted to receive a first elastic ribbon-shaped element 12 fastened at one end 22 to the fabric article. A second ribbon-shaped element 13 is fastened to the first elastic element 12. The second element may be elastic or non-elastic and, together with a rigid lamina 14, completes the retention device 15 according to the present invention. A portion 16 of the second element 13 is partially secured to the lamina 14, leaving free only one end 17 of the lamina.

The two elongated elements 12 and 13 partially overlap and are fastened to each other at at least two points 18 and 19. At point 18 a small lock-lamina 20 is secured between elements 12 and 13.

The overlapping portion 16 of the second element 13 disposed between points 18 and 19 must be longer than the overlapping portion 21 of the first elastic element 12 between points 18 and 19. Lamina 14 can have a length at most equal to that of elastic portion 21, but definitely less than the length of portion 16.

The joining of the different portions and materials provided herein is effected by sewing, seaming, glueing or in other known ways, depending upon the material used.

The ribbon-shaped elements 12 and 13 may be cord-like elements, tapes, strips or the like adapted to be disposed within a sleeve or seating provided on fabric items such as linen or clothing to provide stable gathering and retention of portions of the fabric.

In use, a retention device according to the present invention, as described, functions in the following way.

In the non-operative position the device 15 appears as shown as in FIGS. 1 and 2, i.e. concealed within the seating 11 with the fabric article ungathered.

To cause the fabric article 10 to adhere perfectly to an article or person encased thereby (not shown), the fabric 10 and related cover strip 9 are caused to gather by pulling the free end of the second ribbon-shaped element 13 protruding from seating 11. As this force is exerted the first element held within seating 11 is substantially withdrawn from seating 11. During exertion of this pulling force portion 21 of the elastic element 12 lengthens until it is equal in length to portion 16 of element 13, permitting lamina 14 to unlatch from lock-lamina 20.

Figure 3:
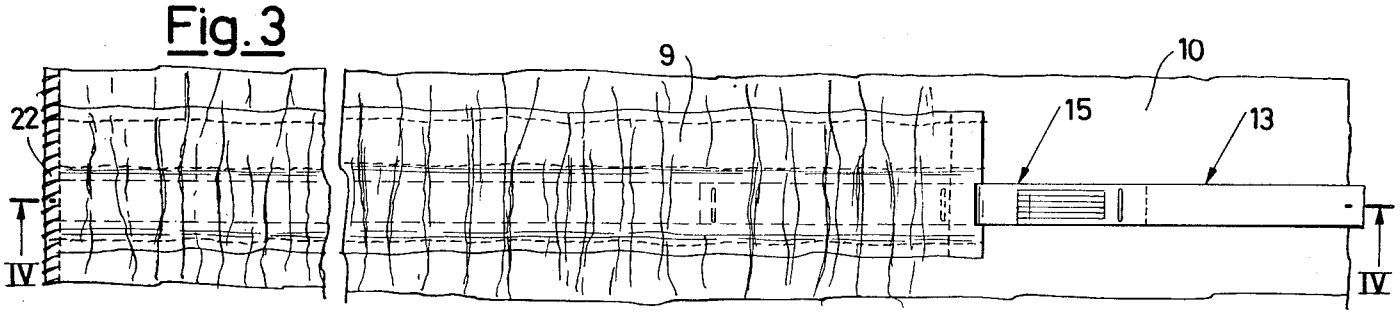
FIG. 3 is a plan view of the element of FIG. 1 shown operationally actuated and locked.
Figure 4:
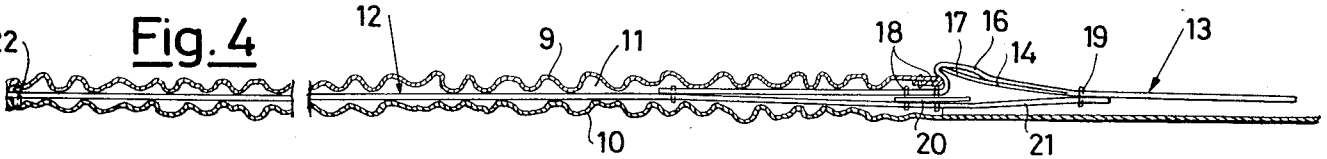
FIG. 4 is a sectional view in the direction of the line IV—IV of FIG. 3.

As element 13 is subsequently released, elastic portion 21 resiliently resumes its initial dimension. The combined resiliency of the elastic portion 21 and the pulling force transmitted to lamina 14 by portion 16 cause lamina 14 attached to portion 16 of ribbon-shaped element 13 to move away from lock-lamina 20. End 17 of lamina 14 then engages the front edge of element 9 at the entry of seating 11, becoming locked in the position shown in FIGS. 3 and 4 to secure the fabric article 10 in the gathered position.

To release the device 15 from the gathered position element 13 is again pulled and lamina 14 is disengaged from the front edge of the open end of the seating 11. End 17 of lamina 14 is then pushed below the lock-lamina 20 and the second ribbon-shaped element 13 is released. Element 13, drawn by the elastic ribbon-shaped element 12, re-enters the seating 11, drawing the retention device 15 into the seating (See FIGS. 1 and 2).

Alternatively, lock-lamina 20 can be omitted, and re-entry of the retention device 15 into the seating 11 can be aided and caused to occur by the user.

Figure 5:
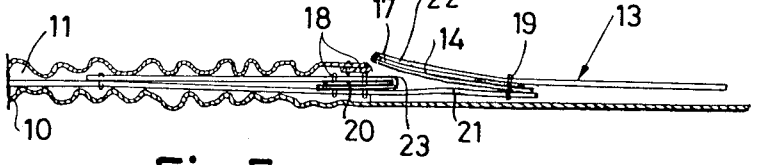
FIG. 5 is a partial sectional view similar to FIGS. 2 and 4 of a second preferred embodiment according to the present invention, showing an alternate lamina construction.

FIG. 5 illustrates a second preferred embodiment of the present invention also having laminas 14 and 20, but wherein the portion 16 is divided into two parts: a first part 22 which enwraps the lamina 14 and a second part 23 which enwraps the lock-lamina 20. The device according to this embodiment operates in the same manner previously described in relation to the first preferred embodiment, both as to retention and disengagement of the device.

The gathering and retention device according to the present invention can, for example, be used with advantage in covers adapted to protect or otherwise enclose finished articles, or in clothing articles such as windbreakers to obtain good closure and adherence to the body of the wearer.

To the extent not already indicated, it also will be understood by those of skill in the art that any of the various specific embodiments herein described and illustrated may be further modified to incoporate features shown in any of the other specific embodiments, as described.

The invention in its broader aspects therefor is not limited to the specific embodiments herein shown and described but departures may be made therefrom within the scope of the accompanying claims, without departing from the principles of the invention and without sacrificing its chief advantages.

I claim:

1. A device for gathering and retaining a portion of a fabric article comprising:

a first elongated element connected at one end to the fabric article and slidable within a seating provided on the fabric article, said seating having an opening therein;

a second elongated element slidable within said seating and protruding freely from said seating through said opening, said second element being connected to said first element at at least two points such that said first and second elements overlap between said connection points, the overlapping portion of said second element being longer than the overlapping portion of said first element; and a rigid lamina connected to said overlapping portion of said second element, said rigid lamina being able to assume a first position adjacent to said overlapping portion of said element when said seating is in an ungathered configuration and a second position engaging said seating opening when said seating is in a gathered configuration.

2. The device according to claim 1 wherein said first elongated element is elastic and said second elongated element is substantially non-elastic.

3. The device according to claim 1, further comprising a lock-lamina for removably locking said rigid lamina in said first position.

4. The device according to claim 3, wherein said overlapping portion of said second element further comprises two sections and said rigid lamina and said lock-lamina are each enwrapped by one of said two sections.

5. The device according to claim 1 wherein said overlapping portion of said first element is elastic and said overlapping portion of said second element is essentially non-elastic.

6. The device according to claim 1 wherein both said first and second elongated elements are elastic.

7. The device according to claim 1 wherein said connections between said first and second elements, said first element and said fabric article, and said rigid lamina and said overlapping portion of said second element are weldings.

8. The device according to claim 1 wherein said connections between said first and second elements, said first element and said fabric article, and said rigid lamina and said overlapping portion of said second element are seamings.

9. The device according to claim 1 wherein said connections between said first and second elements, said first element and said fabric article, and said rigid lamina and said overlapping portion of said second element are stitchings.

10. The device according to claim 3 wherein said lock-lamina is secured at one of said two points of connection between said first and second elongated elements and said rigid lamina is fastened to said overlapping portion of said second element in the vicinity of the other of said two points of connection between said first and second elongated elements.

11. A device for gathering and retaining a portion of a fabric article comprising:

a first elongated element fastened at one end to the fabric article and slidable within a seating provided on the fabric article, said seating having an opening therein;

a second elongated element slidable within said seating and protruding freely from said seating opening, said second element overlapping said first element and being connected at a point away from the ends of said second element to said first element adjacent to the end of said first element not attached to said fabric article;

a first rigid lamina fastened to said second elongated element in facing relationship with said overlapping portion of said second element; and a second rigid lamina fastened to said first elongated element adjacent to the end of said second elongated element such that said first rigid lamina is able to assume a first position adjacent to said first element and engaging said second rigid lamina when said seating is in an ungathered configuration and a second position disengaged from said second rigid lamina and engaging said seating opening when said seating is in a gathered configuration.

12. The device according to claim 11 wherein said second elongated element enwraps said first rigid lamina.

13. The device according to claim 12 further comprising a third elongated element fastened to said first elongated element in facing relationship with said first element such that said second rigid lamina is enwrapped by said third element.

14. The device according to claim 13 wherein said first elongated element is elastic and said second and third elements are substantially non-elastic.

15. The device according to claim 11 wherein said first elongated element is elastic and said second elongated element is substantially non-elastic.

16. The device according to claim 11 wherein both said first elognated element and said second elongated element are elastic.

* * * * *